US007298088B2

(12) United States Patent
Iida et al.

(10) Patent No.: US 7,298,088 B2
(45) Date of Patent: Nov. 20, 2007

(54) ARC TUBE AND LOW-PRESSURE MERCURY LAMP

(75) Inventors: Shiro Iida, Kyoto (JP); Akiko Nakanishi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 364 days.

(21) Appl. No.: 10/508,786

(22) PCT Filed: Mar. 17, 2003

(86) PCT No.: PCT/JP03/03145

§ 371 (c)(1),
(2), (4) Date: Sep. 23, 2004

(87) PCT Pub. No.: WO03/083895

PCT Pub. Date: Oct. 9, 2003

(65) Prior Publication Data

US 2005/0151477 A1 Jul. 14, 2005

(30) Foreign Application Priority Data

Mar. 29, 2002 (JP) ..... 2002-096614

(51) Int. Cl.
*H01J 17/16* (2006.01)
*H01J 61/33* (2006.01)
*H01J 61/30* (2006.01)

(52) U.S. Cl. ..... 313/634; 313/637; 313/639; 313/573; 315/291; 315/56; 315/63

(58) Field of Classification Search ..... 313/634
See application file for complete search history.

(56) References Cited

U.S. PATENT DOCUMENTS

| | | | | |
|---|---|---|---|---|
| 4,746,835 | A | 5/1988 | Imamura et al. | 313/493 |
| 5,705,883 | A | 1/1998 | Soules et al. | 313/318.09 |
| 5,751,104 | A | 5/1998 | Soules et al. | 313/493 |
| 5,882,237 | A * | 3/1999 | Sarver et al. | 445/9 |
| 5,925,978 | A | 7/1999 | Holzer | 313/493 |
| 6,225,742 | B1 | 5/2001 | Iida et al. | 315/56 |
| 6,337,539 | B1 | 1/2002 | Yorifuji et al. | 315/56 |
| 6,437,502 | B1 * | 8/2002 | Nishio et al. | 313/493 |
| 6,633,128 | B2 * | 10/2003 | Ilyes et al. | 313/634 |

(Continued)

FOREIGN PATENT DOCUMENTS

JP 62-76149 4/1987

(Continued)

*Primary Examiner*—Sikha Roy

(57) ABSTRACT

This invention aims at providing a low-pressure mercury lamp having an improved luminous efficiency while maintaining the compactness and long life of the arc tube. This lamp comprises an arc tube formed by bending a glass tube. This arc tube is formed into a double-spiral structure comprising: a turning part located in substantially the midsection from both ends of the glass tube; a first spiral part starting from one of the ends and spiraling around the pivotal axis to reach the turning part; and a second spiral part starting from the turning part and spiraling around the pivotal axis to the other end. The glass tube has a circular shape in cross section with 7.4 mm inner diameter. This low-pressure mercury lamp is a 12 W lamp alternative to a 60 W incandescent lamp, and the bulb wall loading under steady state illumination is set at 0.103 W/cm$^2$.

18 Claims, 7 Drawing Sheets

U.S. PATENT DOCUMENTS

| | | | | |
|---|---|---|---|---|
| 6,744,205 | B2 * | 6/2004 | Iida et al. | 313/634 |
| 6,759,797 | B2 * | 7/2004 | Tokes et al. | 313/318.01 |
| 7,059,929 | B2 * | 6/2006 | Iida et al. | 445/26 |

FOREIGN PATENT DOCUMENTS

| | | | |
|---|---|---|---|
| JP | 64-81162 | | 3/1989 |
| JP | 05089832 | A * | 4/1993 |
| JP | 05151935 | A * | 6/1993 |
| JP | 6-76797 | | 3/1994 |
| JP | 7-14544 | | 1/1995 |
| JP | 8-212975 | | 8/1996 |
| JP | 8-339780 | | 12/1996 |
| JP | 9-245740 | | 9/1997 |
| JP | 9-272375 | | 10/1997 |
| JP | 10-199482 | | 7/1998 |
| JP | 2000-21351 | | 1/2000 |
| JP | 2000-67812 | | 3/2000 |
| JP | 2000-173537 | | 6/2000 |
| JP | 2001-68060 | | 3/2001 |
| JP | 2001-167734 | | 6/2001 |
| JP | 2002-75275 | | 3/2002 |

* cited by examiner

ARC TUBE AND LOW-PRESSURE MERCURY LAMP

TECHNICAL FIELD

The present invention relates to an arc tube having a glass tube that is wound into a spiral structure and a low-pressure mercury lamp using this arc tube.

BACKGROUND ART

Today in an age of energy conservation, low-pressure mercury lamps that exhibit high luminous efficiency and long operating life have received attention. In particular, compact self-ballasted fluorescent lamps have been examined as a light source alternative to the incandescent lamps. Note that, hereafter, compact self-ballasted fluorescent lamps are referred to as 'lamps.' On the other hand, fluorescent lamps, such as a compact single-capped fluorescent lamp, are referred to as 'fluorescent lamps' in distinction from the compact self-ballasted fluorescent lamps.

Such lamps, each of which comprises an arc tube formed by bending a glass tube, a ballast circuit for lighting the arc tube, and a case housing this ballast circuit therein and having a base. Note here that these are a type of lamp that has no globe encasing the arc tube.

Among arc tubes used for the above lamps, there is a type that is formed with multiple, for example three, U-shaped glass tubes held together. However, there is another type that is increasingly being adopted late years. That is an arc tube formed in the shape of a double spiral. The shape of the double-spiral arc tube can be described as a single glass tube being bent double in approximately the midsection from its both ends and each limb of the bent glass tube being formed into a spiral structure. The reason the double-spiral arc tube is now being adopted is that forming an arc tube into the shape of a double spiral allows for effective use of limited space, and the double-spiral arc tube becomes smaller than an arc tube comprising multiple U-shaped glass tubes. The lamps, which are alternative to a 60 W incandescent lamp, are being reduced in size to almost the same dimensions of the incandescent lamps.

In a lamp utilizing a double-spiral arc tube, the bulb wall loading is set high in order to attain the same luminous flux as a incandescent lamp. For this reason, the cold spot temperature of the glass tube under steady state illumination exceeds the optimum temperature of the glass tube at which the maximum luminous flux is radiated (this optimum temperature is, hereafter, referred to as an 'optimum cold spot temperature'). As a result, the lamp with a double-spiral arc tube fails to achieve the best luminous efficiency.

In the lamp using a double-spiral arc tube, in order to approximate the cold spot temperature of the glass tube under steady state illumination to its optimum cold spot temperature, for instance, the apical part of the arc tube is bulged so that more area is provided for heat dissipation. Consequently, a 13 W lamp, alternative to a 60 W incandescent lamp (luminous flux: 810 lm), has obtained a luminous flux of approximately 800 lm and a luminous efficiency of 62 lm/W. In the case of a 23 W lamp, alternative to a 100 W incandescent lamp (luminous flux: 1520 lm), a luminous flux of about 1500 lm and a luminous efficiency of 65 lm/W have been attained. Note that both these lamps, a 13 W and a 23 W lamp, have achieved a rated life of 6000 hours or more.

As just described, in the conventional double-spiral arc tube lamps, the cold spot temperature has been lowered by bulging the apical part of the arc tube. However, the cold spot temperature under steady state illumination yet exceeds the optimum cold spot temperature, and therefore the improvement in luminous efficiency is still far from adequate.

Take notice that, for the purpose of lowering the cold spot temperature of the glass tube, if for instance the bulb wall loading is reduced, a desired luminous flux cannot be obtained. Additionally, enlarging the diameter of the glass tube ends up with an increase in size of the arc tube.

DISCLOSURE OF THE INVENTION

A first object of the present invention is to provide an arc tube in which the cold spot temperature of the glass tube under steady state illumination is brought to almost the same as the optimum cold spot temperature at which the maximum luminous flux is radiated when the arc tube is lighted.

A second object of the present invention is to provide a low-pressure mercury lamp having an improved luminous efficiency without causing a reduction in the luminous flux radiated from the arc tube or an enlargement in size of the arc tube.

In order to achieve the first object above, the arc tube of the present invention is an arc tube having a glass tube that is wound into a spiral structure. The glass tube has an inner shape of a substantially circular cross section, and has an inner diameter in the range of 5 to 9 mm inclusive. In the arc tube, the bulb wall loading is set so that the temperature of the coldest spot within the glass tube under steady state illumination falls into the range of 60 to 65° C. inclusive.

By means of this structure, the cold spot temperature of the glass tube under steady state illumination can be brought to almost the same as the optimum cold spot temperature at which the maximum luminous flux is radiated. This leads to the extension of lamp operating life as well as an improvement of luminous efficiency.

Further, in order to accomplish the above first object, the arc tube of the present invention is an arc tube having a glass tube that is wound into a spiral structure. The glass tube has an inner shape of a substantially elliptical cross section, with an inner tube major axis in the range of 5 to 9 mm inclusive and an inner tube minor axis of 3 mm or larger. In the arc tube, the bulb wall loading is set so that the temperature of the coldest spot within the glass tube under steady state illumination falls into the range of 60 to 65° C. inclusive.

By means of this structure, the cold spot temperature of the glass tube under steady state illumination can be brought to almost the same as the optimum cold spot temperature at which the maximum luminous flux is radiated.

In the above arc tube, the bulb wall loading is set within the range of 0.08 to 0.12 W/cm$^2$ inclusive. Thus, the bulb wall loading has been reduced, which results in extending the operating life of the arc tube.

The glass tube is formed into the shape of a double spiral that comprises a turning part, a first spiral part, and a second spiral part. The turning part is located in approximately the midsection of the glass tube. The first spiral part starts from one end of the glass tube and spirals around the pivotal axis to reach the turning part. The second spiral part starts from the turning part and spirals around the pivotal axis to the other end of the glass tube.

In the arc tube of claim 3 of the present invention, alternatively, the glass tube is in a shape of double-spiral that comprises a turning part, a first spiral part, and a second spiral part. The turning part is located in approximately the midsection of the glass tube. The first spiral part starts from one end of the glass tube and spirals around the pivotal axis to reach the turning part. The second spiral part starts from the turning part and spirals around the pivotal axis to the other end of the glass tube. This structure allows for effective use of limited space and, therefore, a reduction in size of the arc tube.

Furthermore, the glass tube is formed so as to fit into a cylindrical space of maximum diameter in the range of 30 to 40 mm inclusive and maximum length in the range of 50 to 100 mm inclusive. Consequently, if being provided with the arc tube formed with this glass tube, the compact self-ballasted fluorescent lamp becomes smaller than a incandescent lamp. In addition, this compact self-ballasted fluorescent lamp can be applied to lighting apparatuses designed to use the conventional, incandescent lamps.

In order to accomplish the second object above, the low-pressure mercury lamp of the present invention is provided with the above-mentioned arc tube. Accordingly, the cold spot temperature of the glass tube under steady state illumination can be brought to almost the same as the optimum cold spot temperature at which the maximum luminous flux is radiated when the arc tube is lighted, without reducing the luminous flux radiated from the arc tube or enlarging the size of the arc tube. This leads to an improvement of luminous efficiency.

BEST MODE FOR CARRYING OUT THE INVENTION

EMBODIMENTS

The following will describe preferred embodiments, in which the arc tube of the present invention is applied to a compact self-ballasted fluorescent lamp, with reference to the drawings.

First Embodiment

[1] Structure of Compact Self-Ballasted Fluorescent Lamp

1) Overall Structure

Figure 1:
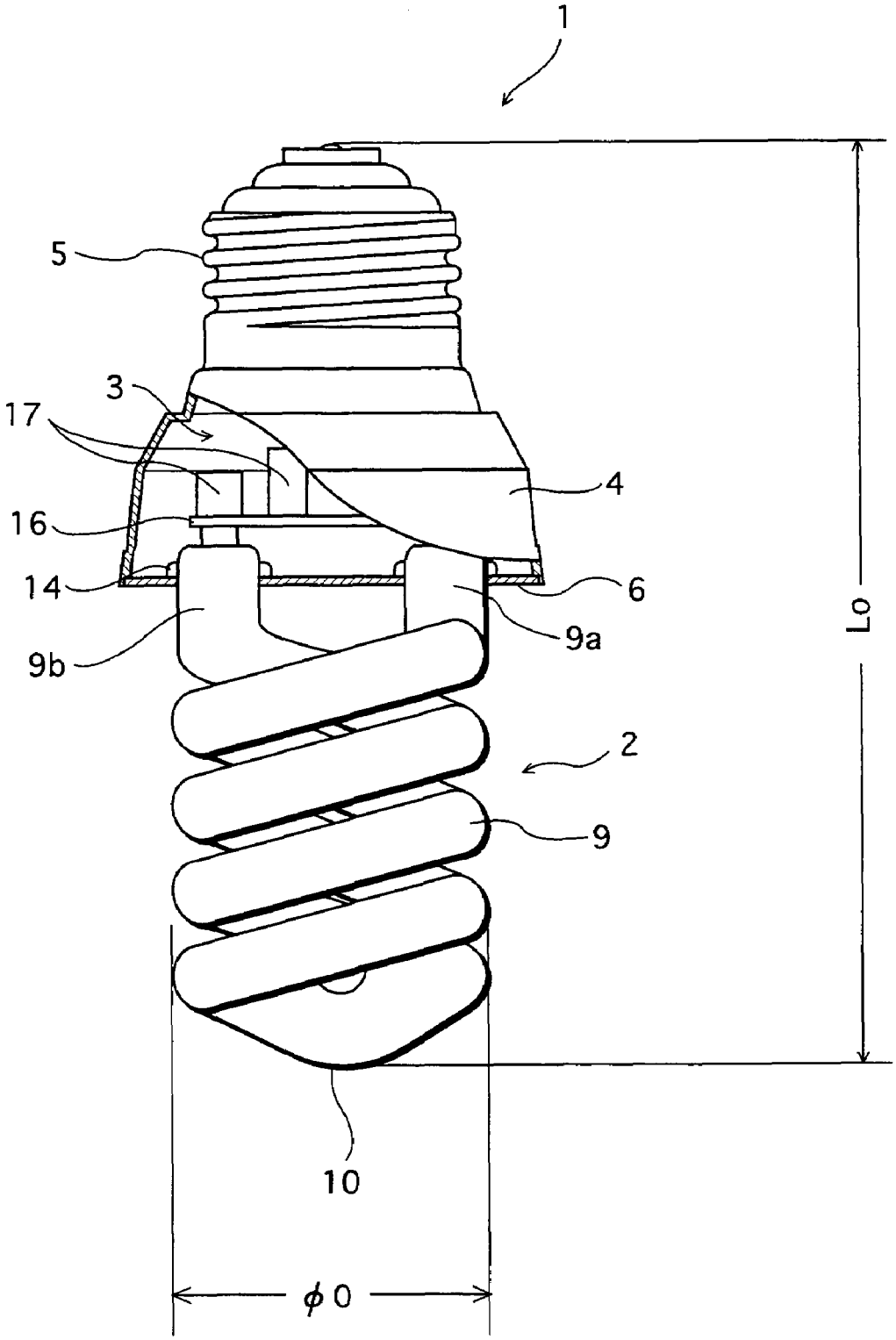
FIG. 1 is a front view showing the overall structure of the lamp according to the first embodiment, with a part cut away to reveal the internal arrangements.

FIG. 1 is a front view showing the overall structure of the compact self-ballasted fluorescent lamp according to the present invention, with a part cut away to reveal the internal arrangements. This compact self-ballasted fluorescent lamp 1 (hereafter, referred to simply as a 'lamp 1') is a 12 W lamp, alternative to a 60 W incandescent lamp. Here, a 13 W lamp, which is also alternative to a 60 W incandescent lamp and has been described in the related art above, is sometimes referred to as a 'conventional lamp.'

As shown in the figure, the lamp 1 comprises: an arc tube 2 being wound into a double-spiral structure, a ballast circuit 3 for lighting the arc tube 2, and a case 4 housing the ballast circuit 3 therein. The case 4 is provided with a base 5 at the upper end, and a holder 6, which holds the arc tube 2, at the lower end.

The arc tube 2 extends downwards (i.e. the opposite side to the base 5) from the holder 6 of the case 4. A glass tube 9 that forms the arc tube 2 is bent double at a turning part 10 which is located in approximately the midsection from both ends 9*a* and 9*b* of the glass tube. Both ends 9*a* and 9*b* of the glass tube 9 are fixed to the holder 6.

Figure 2A:
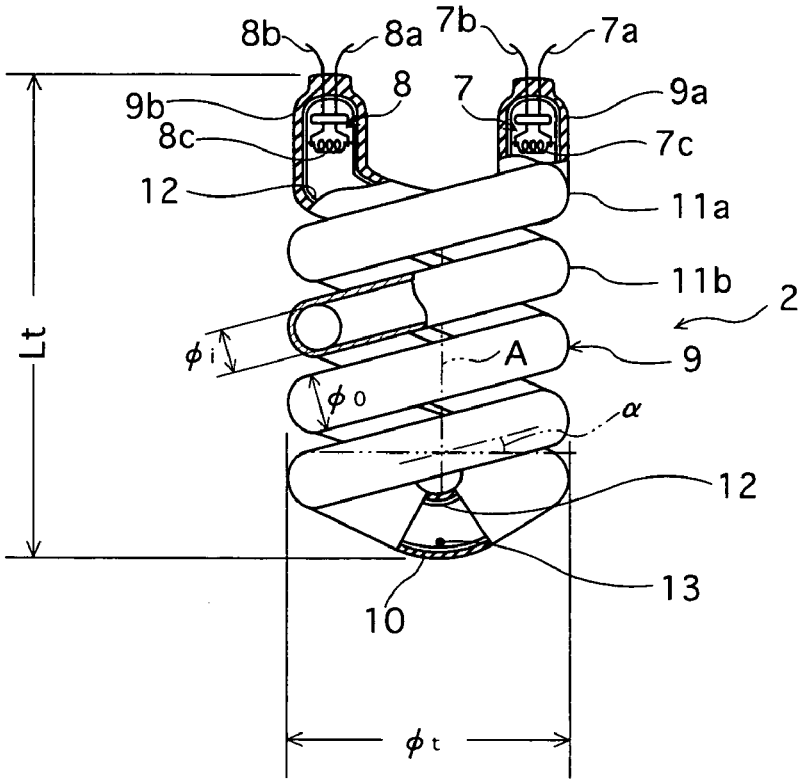
FIG. 2A is a front view showing the structure of the arc tube according to the first embodiment, with parts cut away to reveal the internal arrangements.

FIG. 2A is a front view showing the structure of the arc tube, with parts cut away to reveal the internal arrangements.

The glass tube 9 has a double-spiral structure that includes two spiral parts: a first spiral part 11*a* starting from one end 9*a* of the glass tube 9 and spiraling down around the pivotal axis A to reach the turning part 10 located at the bottom, and a second spiral part 11*b* starting from the turning part 10 and spiraling up around the same pivotal axis A to the other end 9*b* of the glass tube 9. Together the first and second spiral parts 11*a* and 11*b* revolve around the pivotal axis A substantially five times.

The structure of the glass tube 9 spiraling around the pivotal axis A as stated above is referred to, using the number of times that the glass tube revolves around the pivotal axis A, as for example 'five-wind.' In addition, the first and second spiral parts 11*a* and 11*b* of the glass tube 9 spiral around the pivotal axis A inclining at a predefined angle $\alpha$ from the horizontal direction (i.e. the direction perpendicular to the pivotal axis A). This predefined angle $\alpha$ is hereinafter referred to as a 'helix angle.'

The reason a double spiral has been chosen here as the shape of the arc tube 2 is that a spiral-shaped arc tube makes more effective use of limited space than an arc tube formed with U-shaped glass tubes. For instance, the spiral configuration allows for providing a longer distance between the electrodes within the arc tube and reducing in size of the whole arc tube 2.

Electrodes 7 and 8 are individually sealed in at the ends 9*a* and 9*b* of the glass tube 9. The electrodes 7 and 8 are formed in which respective tungsten filament coils 7*c* and 8*c* are suspended and held on a pair of lead wires 7*a* and 7*b*, and 8*a* and 8*b*. Each pair of the lead wires 7*a* and 7*b*, and 8*a* and 8*b* is temporarily fixed in place by means of bead mounting.

As to the electrodes 7 and 8, each pair of the lead wires 7*a* and 7*b*, and 8*a* and 8*b* is sealed in the glass tube 9, with the filament coils 7*c* and 8*c* each being inserted into the glass tube 9 in the vicinity of one of both ends. In this way, the hermeticity of the glass tube 9 is maintained.

In this hermetically sealed glass tube 9, about 3 mg of elemental mercury is enclosed, and an argon and neon gas which act as a buffer gas are sealed at 300 Pa. In addition, a rare-earth phosphor 12 is applied to the inner surface of the glass tube 9. The phosphor 12 used here is a mixture of three types of phosphors respectively emitting red, green, and blue light: $Y_2O_3$:Eu, $LaPO_4$:$Ce_2$Tb, and $BaMg_2Al_{16}O_{27}$.:Eu and Mn. The coldest spot 13, a point having the lowest temperature within the glass tube during illumination, is formed at the apical part of the arc tube 2, i.e. the turning part 10.

Referring now back to FIG. 1, it is shown that a substrate 16, on which electric components 17 for lighting the arc tube 2 are attached, is provided on the inner side of the holder 6. The electric components 17 make up the ballast circuit 3. This ballast circuit 3 is a series inverter circuit, and the circuit efficiency is 91%.

The case 4 is made of a synthetic resin, and has a cone shape with an opening provided at the lower end as shown in FIG. 1. The holder 6 is placed covering the opening of the case 4 in the manner that the side to which the ballast circuit 3 is attached faces the inside of the case 4. Kept in this configuration, the marginal rim of the holder 6 is fixed to the peripheral wall of the case 4 with an appropriate attachment method, for example, using an adhesive or screws.

For the base 5 located at the top of the case 4, a screw base, such as E26 and E17, is often used. Note here that the electrical connections between the arc tube 2 and the ballast circuit 3 as well as between the base 5 and the ballast circuit 3 are not shown in FIG. 1. The overall length of the lamp 1, i.e. the length from the tip of the base 5 in the case 4 to the apical part of the arc tube 2 is here denoted as Lo while the outer diameter of the arc tube 2 is denoted as ϕO.

2) Specific Structure

The following gives account of the specific structure of the embodiment of the present invention.

Figure 2B:
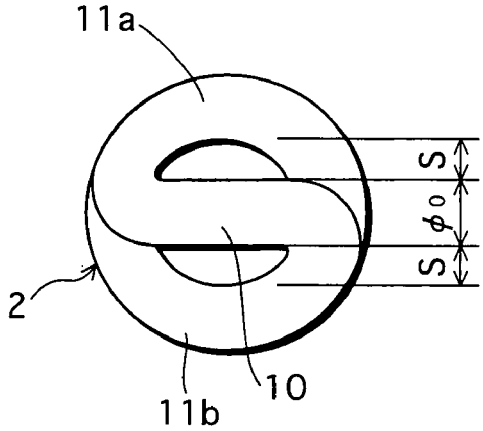
FIG. 2B is a bottom view of the arc tube according to the first embodiment.

As illustrated in FIG. 2, the glass tube 9 that forms the arc tube 2 has a tube inner diameter ϕi of 7.4 mm and a tube outer diameter ϕo of 9.0 mm. In the arc tube 2, the distance between the electrodes 7 and 8 (hereafter simply 'electrode distance') is set at 450 mm. The glass tube 2 has a shape of a substantially five-wind double spiral, i.e. revolving around the pivotal axis A substantially five times.

As to the arc tube 2, the outer structural diameter ϕt is set at 37 mm while the structural length Lt is 60 mm. Compared to the arc tube of the conventional 13 W lamp (outer structural diameter, ϕO: 45 mm, structural length, Lt: 70 mm), this arc tube 2 has been reduced in size by 8 mm in outer structural diameter and by 10 mm in structural length. Note that the structural length Lt is the length of the arc tube 2 measured in parallel to the pivotal axis A.

Within the arc tube 2, the bottom portions of the first and second spiral parts 11*a* and 11*b* are respectively folded back in the vicinity of the turning part 10 of the glass tube 9. As shown in the FIG. 2B, there are interspaces S between the turning part 10 and each of the folded-back bottom portions, and these interspaces S become 5 mm each since the tube outer diameter ϕi of the glass tube 9 is 9.0 mm. As a result, a ratio of the non-light-emitting areas (interspaces) to the light-emitting area (both spiral parts 11*a* and 11*b*, and the turning part 10) is reduced when viewed from the bottom of the arc tube 2. Accordingly, the luminous distribution becomes substantially uniform, and furthermore the illuminance from the bottom of the arc tube 2, namely vertical illuminance, increases.

While the overall length of the 60 W incandescent lamp is 110 mm, that of the lamp 1 is 105 mm as shown in FIG. 1, and thus the lamp 1 is 5 mm shorter in length.

The following explains the performance of the lamp 1 having the above structure.

The lamp 1 was lighted with its base 5 side up (hereafter, simply 'the base-up position') by providing the rated input power of 12 W (bulb wall loading: 0.103 W/cm$^2$). The luminous flux of the lamp 1 was 893 lm, while the luminous efficiency was 74.2 lm/W.

The lamp 1 obtained an about 1.1 times larger luminous flux than the conventional lamp with 800 lm, and the luminous efficiency was about 1.2 times higher than that of the conventional lamp, 62 lm/W. At the same time, the result shows that the rated life of the lamp 1 was 10550 hours, by far exceeding 6000 hours. Just for reference, within the glass tube 9 of the lamp 1 lighted under the above conditions, the temperature at the coldest spot was 62° C.

[2] Items To Be Examined

As to the conventional lamp, the cold spot temperature of the glass tube under steady state illumination exceeds the optimum cold spot temperature. Given this factor, the inventors thought that the luminous efficiency would be improved if the cold spot temperature under steady state illumination was lowered to the optimum cold spot temperature. In short, a study was carried out on a method for lowering the cold spot temperature under steady state illumination.

1) Relationship Between Tube Inner Diameter and Temperature of Glass Tube

An optimum cold spot temperature $T_1$, at which the maximum luminous flux is radiated, was measured for respective glass tubes whose tube inner diameters ϕi differing from 5 mm to 12 mm. To be more specific, the glass tubes 9, of which the tube inner diameters ϕi vary from 5 mm to 12 mm at an interval of 1 mm, were prepared, and arc tubes were formed using these glass tubes 9. Then, lamps 1, to each of which was provided with one of the arc tubes, were produced and used to measure an optimum cold spot temperature $T_1$ for each tube inner diameter ϕi.

The measuring method was employed in which the lamps 1 were placed in a thermostatic chamber where the temperature is controllable, and the mercury vapor pressure within the arc tubes 2 was varied. To be more specific, the temperature in the thermostatic chamber was altered in order to change the mercury vapor pressure within the arc tube 2. Under the conditions, the temperature at the coldest spot (the cold spot temperature $T_1$), at which the arc tube 2 radiates the maximum luminous flux, was measured.

As described above, the variation range of the tube inner diameters ϕi was 5-12 mm. This is because it is difficult to insert the filament coils 7*c* and 8*c* into the ends of the glass tube 9 if the tube inner diameter ϕi is smaller than 5 mm. On the other hand, if the tube inner diameter ϕi is larger than 12 mm, then the whole arc tube 2 increases in size, which results in increasing the size of lamp 1.

Figure 3:
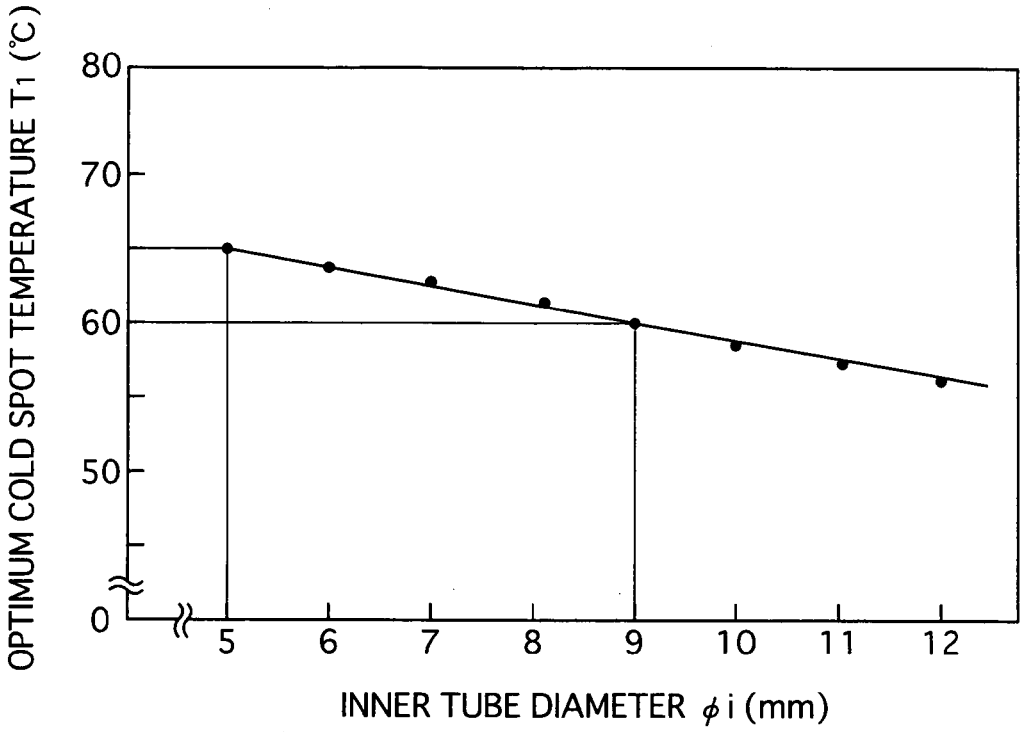
FIG. 3 plots the optimum cold spot temperature at which the arc tube radiates the maximum luminous flux versus the tube inner diameter of the glass tube.

FIG. 3 shows the results of the above measurements. It can be seen that the optimum cold spot temperature T, increases as the tube inner diameter ϕi of the glass tube 9 becomes smaller as shown in the figure.

Here the conditions, under which the lamp 1 radiates the maximum luminous flux with a given tube inner diameter ϕi of the glass tube 9, were controlled using the temperature of the glass tube 9. This is because these conditions are determined by the mercury vapor pressure within the arc tube 2, namely the temperature therein. As the mercury vapor pressure within the arc tube 2 increases, the luminous flux also increases up to the optimum cold spot temperature $T_1$. Note, however, that the luminous flux decreases after the optimum cold spot temperature $T_1$ even if the mercury vapor pressure increases. This is because ultraviolet radiation emitted from a mercury atom is absorbed by another mercury atom when the number of mercury atoms becomes excessive within the discharge space.

2) Relationship Between Cold Spot Temperature and Bulb Wall Loading

The luminous efficiency should be improved if the cold spot temperature of the glass tube 9 under steady state illumination reaches in fact the same value as the optimum cold spot temperature $T_1$ described above. According to the above results obtained for the tube inner diameter φi and the optimum cold spot temperature $T_1$, it can be seen that, in order to raise the luminous efficiency, the cold spot temperature should be maintained between 60-65° C. when the arc tube 2 with the tube inner diameter φi in the range of 5 mm to 9 mm is lighted under steady state illumination.

The range of the tube inner diameter φi was set at 9 mm or less. This is because a glass tube whose tube inner diameter falls into this range is able to provide a longer electrode distance for the same structural dimensions as well as to reduce the size of the arc tube 2, when compared to the case in which the tube inner diameter φi is 12 mm. As a result, greater flexibility in design for lamps can be offered.

Next, the relationship between the cold spot temperature and the bulb wall loading we of the glass tube 9 under steady state illumination was examined. The arc tubes 2 used for measurement were formed using four different glass tubes 9 with the tube inner diameters φi of 5.0 mm, 6.0 mm, 7.4 mm, and 9.0 mm, respectively. Further, the arc tubes 2 having differing electrode distances Le were experimentally produced for each of these diameter classes. Lamps 1 assembled using these arc tubes 2 were lighted in the base-up position by providing an input power and a power supply voltage of 100 V, and the cold spot temperatures $T_2$ were measured. As to the input power, two different cases were investigated: supplying 12 W and 21 W, each of which is 1-2 W less than the input power applied to the corresponding conventional lamp.

The bulb wall loading we was measured here since the cold spot temperature $T_2$above is determined by the bulb wall loading we. This bulb wall loading we is obtained by dividing an arc tube input by the internal surface area (π×φi×Le) of the arc tube 2. Here, the arc tube input is found by multiplying the rated input power (e.g. 12 W) by the circuit efficiency of the ballast circuit 3 (e.g. 0.91).

Figure 4:
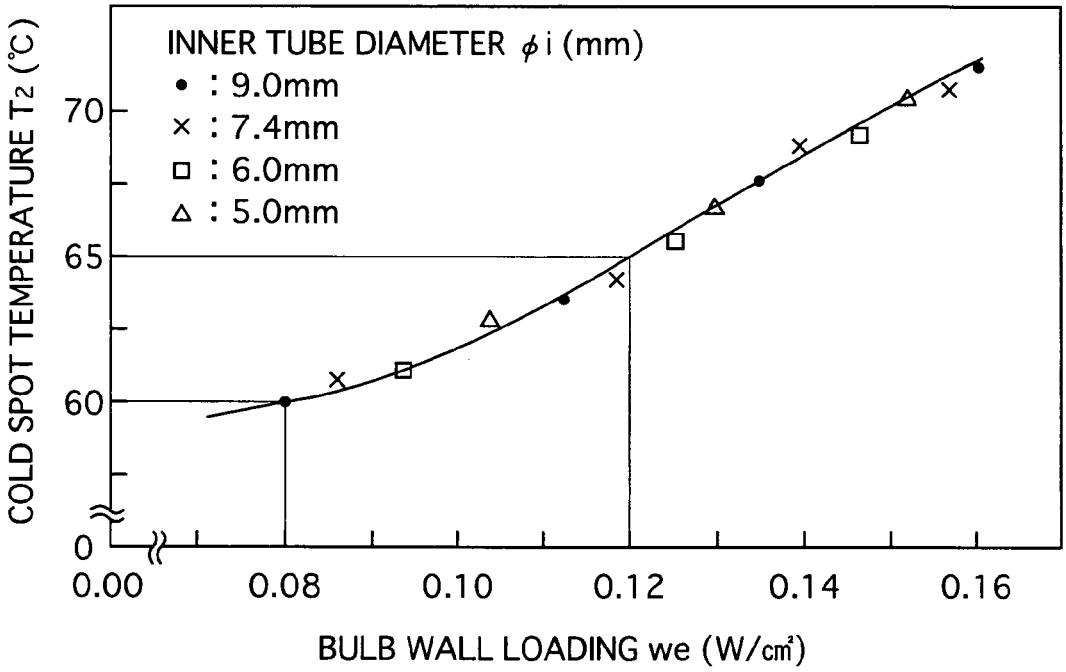
FIG. 4 plots the cold spot temperature of the glass tube versus the bulb wall loading.

FIG. 4 shows the results of these measurements. As shown in the figure, the range of the bulb wall loading we was 0.08-0.12 W/cm$^2$, in which the cold spot temperatures in the glass tubes 9 of respective tube inner diameters φi fell into the range of 60-65° C. This examination revealed that it is appropriate to set the bulb wall loading we within the range of 0.08-0.12 W/cm$^2$ when the arc tube 2 having the tube inner diameter φi in the range of 5-9 mm is used.

The lamp 1 is lighted with the above range of bulb wall loading we (0.08-0.12 W/cm$^2$). This is lower than the range for the conventional lamps (estimated as: 0.139-0.165 W/cm$^2$) The life property of the lamp 1 is improved when the lamp 1 is lighted with the lower range of bulb wall loading we, and it has been also confirmed that an extended rated life of 6000 hours or more can be guaranteed.

3) Review

In view of the above examinations, the structure of the lamp 1 of the current embodiment is summarized as follows: when the tube inner diameter φi is set within the range of 5.0-9.0 mm inclusive and the bulb wall loading we is set within the range of 0.08-0.12 W/cm$^2$ inclusive, the cold spot temperature $T_2$ of the glass tube 9 under steady state illumination gives close agreement with the optimum cold spot temperature $T_1$ at which the arc tube 2 radiates the maximum luminous flux. Thus, the lamp 1 having a significantly high luminous efficiency can be obtained.

Having been described as an alternative to the 60 W incandescent lamp, the lamp 1 has an improved luminous efficiency of 20% (improved from 62 lm/W to 74.2 lm/W). Furthermore, its luminous flux has been increased by 93 lm (from 800 lm to 893 lm). As a matter of course, the lamp 1 has been reduced in size compared to the conventional 13 W lamp.

Second Embodiment

The above first embodiment provided an example in which the present invention is applied to the 12 W lamp, which is an alternative to a 60 W incandescent lamp. Now in the second embodiment, the present invention is applied to a 21 W lamp, which is an alternative to a 100 W incandescent lamp. Note that the 23 W lamp, which is alternative to a 100 W incandescent lamp and was described in the related art above, is referred to as a 'conventional lamp' in the second embodiment.

Figure 5:
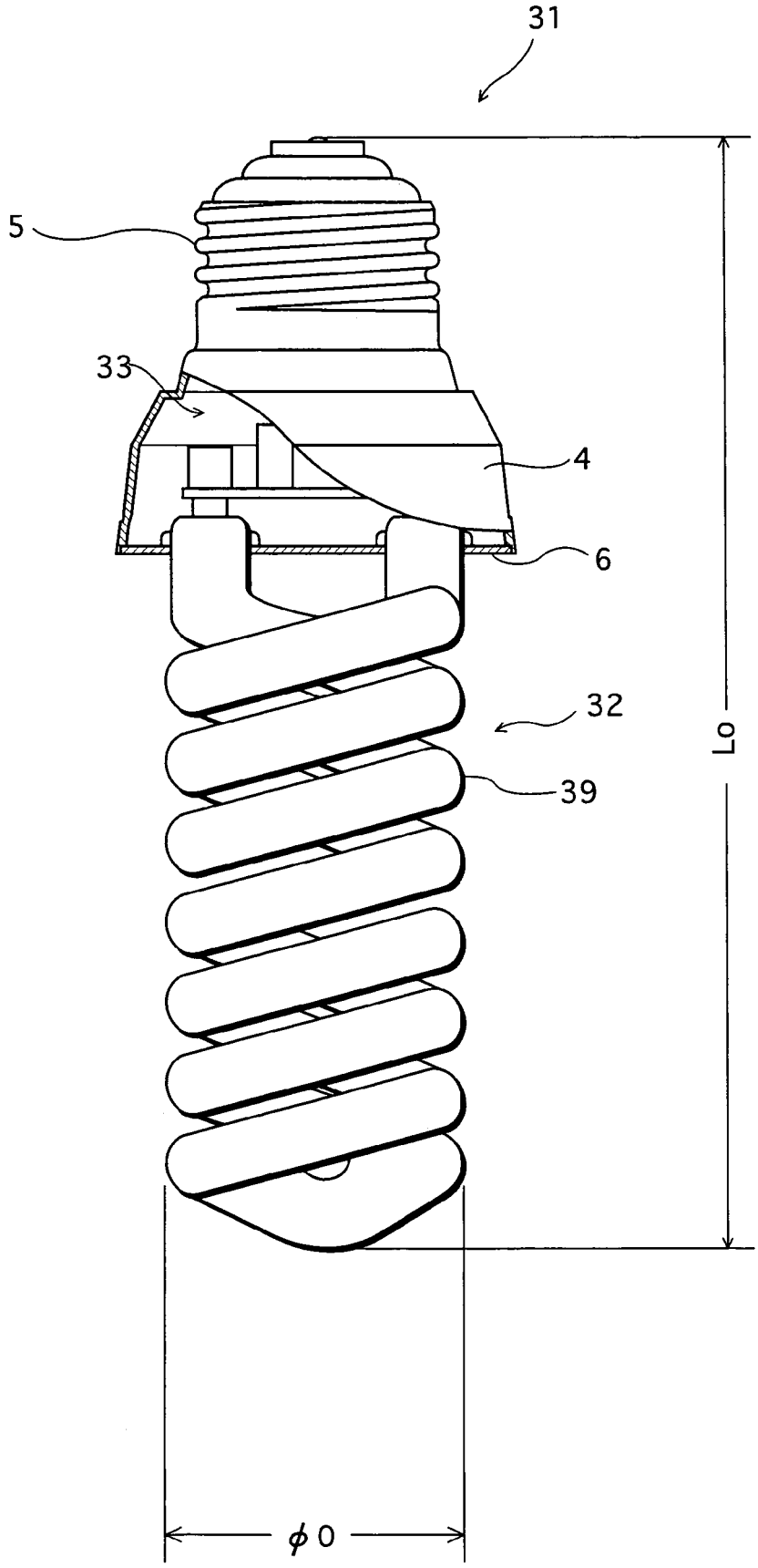
FIG. 5 is a front view of the compact self-ballasted fluorescent lamp according to the second embodiment.

FIG. 5 is a front view showing the overall configuration of the compact self-ballasted fluorescent lamp according to the second embodiment, with parts cut away to reveal the internal arrangements.

The lamp 31 according to the second embodiment has the same basic structure as the lamp 1 of the first embodiment. The differences from the lamp structure of the first embodiment are: the rated input power and the electrode distance of the arc tube 32. Since the lamp 31 is an alternative to the 100 W incandescent lamp, the rated input power is increased to 21 W from 12 W. The electrode distance is increased in order to achieve substantially the same luminous flux as the 100 W incandescent lamp. For this reason, the structure of the arc tube 32 has been altered to a seven-wind double spiral from the five-wind double spiral of the first embodiment. In addition, the ballast circuit 33 is changed in response to the increase in the rated input power from 12 W to 21 W.

In the second embodiment, the tube inner diameter φi of the glass tube 9 is also set within the range of 5.0-9.0 mm inclusive, as well as the bulb wall loading we is set within the range of 0.08-0.12 W/cm$^2$ inclusive, based on the same reason as in the first embodiment.

1) Specific Structure

The glass tube 39 has a tube inner diameter φi of 7.4 mm and a tube outer diameter φo of 9.0 mm, and an arc tube 32 formed using this glass tube 39 has an electrode distance of 640 mm. The glass tube 39 is formed into a seven-wind double spiral, and the arc tube 32 has an outer structural diameter φo of 37 mm and a structural length of 85 mm. The overall length Lo of the lamp 31 is 123 mm.

Compared to the conventional lamp (overall lamp length Lo: 150 mm), the overall lamp length Lo of the lamp 31 is smaller by 27 mm. Thus, the reduction in size of the lamp 31 according to the second embodiment has been achieved.

The following describes the performance of the lamp 31 having the above structure.

When the lamp 31 was lighted in the base-up position by providing the rated input power of 21 W (here, bulb wall loading: 0.103 W/cm$^2$), the luminous flux of 1660 lm and the luminous efficiency of 75.5 lm/W were obtained.

This luminous flux of the lamp 31 is about 1.1 times larger than that of the conventional lamp, 1500 lm, and the luminous efficiency was about 1.2 times higher than that of the conventional lamp, 65 lm/W. At the same time, the result has shown that the rated life of the lamp 31 is 9850 hours, by far exceeding 6000 hours. Just for reference, within the glass tube 39 of the lamp 31 lighted under the above conditions, the temperature at the coldest spot was 63° C.

Modifications

Although the present invention has been hereinbefore described according to respective embodiments, it is apparent that the present invention is not confined to the specific examples shown in the individual embodiments above, and for example the following modifications can be carried out.

(1) Structural Shape of Arc Tube

In the respective embodiments above, the glass tubes were formed so that the structural shape of the arc tubes is substantially circular when viewed in plan. However, the arc tube may be formed into, for example, a substantially elliptical shape when viewed in plan. In this case, however, the mold used to form a glass tube into a double-spiral structure needs to be a split mold that can be split up.

Although the arc tubes are formed into the shape of a double spiral in the respective embodiments, the shape of the arc tube can be for instance a single spiral, and only the part of the glass tube from an end to the turning part spirals around the pivotal axis.

(2) Tube Shape of Arc Tube

Figure 6:
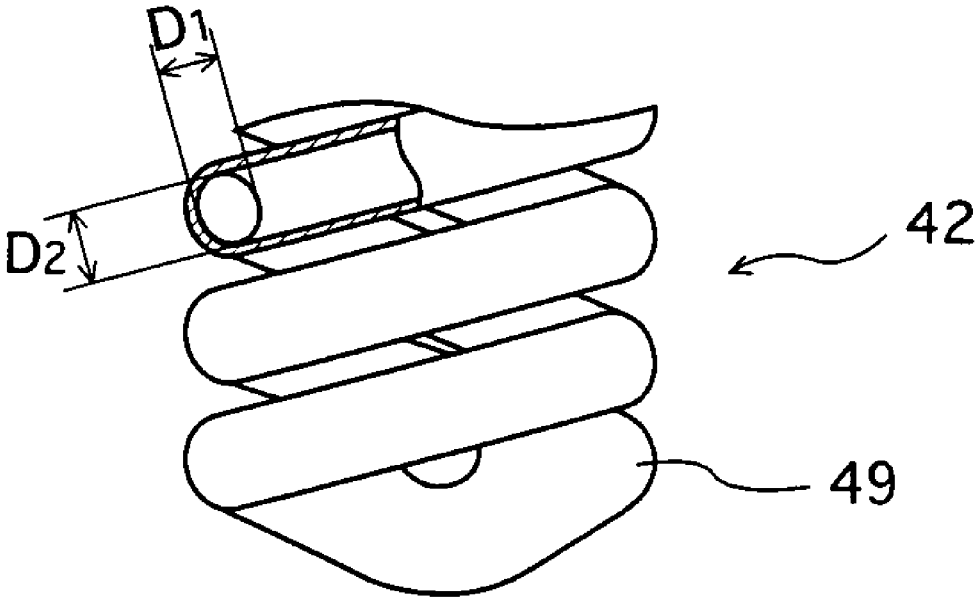
FIG. 6 is a front view of a part of the arc tube according to a modification.

As to the glass tubes in the respective embodiments above, the tube inner shape in cross section is a circle. However, this sectional shape can be noncircular, and an ellipse shown in FIG. 6 is one example of such shapes. Other than an elliptical shape, a V-shape and fan-shape can be adopted.

If an ellipse is adopted as a the tube inner shape of the glass tube 49 in cross section, then the length between the center of the glass tube 49 and the tube inner shape on the minor axis becomes shorter in a cross sectional view, compared to the case when the cross sectional shape is a circle with the diameter being the same as the major axis of the ellipse above. Due to this, it is believed that the fraction of the ultraviolet radiation absorbed by a mercury atom in the ultraviolet radiation emitted from another mercury atom will be declined, which in turn will lead to an increase in luminous flux. Thus, it is expected that the luminous efficiency can be further improved.

In the case of a glass tube having a circular cross section (hereafter, simply 'circular-section glass tube'), it is difficult to insert filament coils into the ends of the glass tube if the tube inner diameter $\phi i$ is less than 5 mm. However, in the case of the glass tube having an elliptical cross section (hereafter, simply 'elliptical-section glass tube'), inserting and putting filament coils in place is feasible if the major axis of the elliptical tube inner shape is 5 mm or more and the minor axis is 3 mm or more. In addition, the dimensions of the electrode's filament coil used in both embodiments are approximately 5 mm×3 mm when viewed from the tube axis of the glass tube.

In addition, when the major axis of the tube inner shape of the elliptical-section glass tube 49 is the same length as the diameter of the tube inner shape of the circular-section glass tube, the arc tube 42 formed with the elliptical-section glass tube 49 provides a longer electrode distance. In the elliptical-section glass tube 49 shown in FIG. 6, the major axis D2 of the tube inner shape lies in the direction approximately parallel to the pivotal axis (refer to FIG. 2 for the pivotal axis) or, more precisely in a direction inclined at the helix angle from the pivotal axis. On the other hand, the minor axis D1 lies in a direction approximately perpendicular to the pivotal axis (to be more precise, a direction inclined at the helix angle from the direction perpendicular to the pivotal axis). Suppose that the major axis D2 is the same length as the diameter of the tube inner shape of the circular-section glass tube. When the elliptical-section glass tube is formed into a double-spiral structure spiraling around the pivotal axis (FIG. 6), the tube inner shape on the side closer to the pivotal axis (i.e. the inwardly-bulging side of the tube inner shape in cross section of the glass tube) is located further away from the pivotal axis compared to the case of the circular-section glass tube. Consequently, the elliptical-section glass tube is able to provide a longer electrode distance than the circular-section glass tube.

(3) Low-pressure Mercury Lamp

The above respective embodiments were described assuming that the low-pressure mercury lamp of the present invention was a compact self-ballasted fluorescent lamp. However, the present invention is not limited to this, and may also be applied to the followings: fluorescent lamps such as a compact single-capped fluorescent lamp, and lamps in which a phosphor is not applied to the inner surface of the glass tube forming an arc tube.

Figure 7:
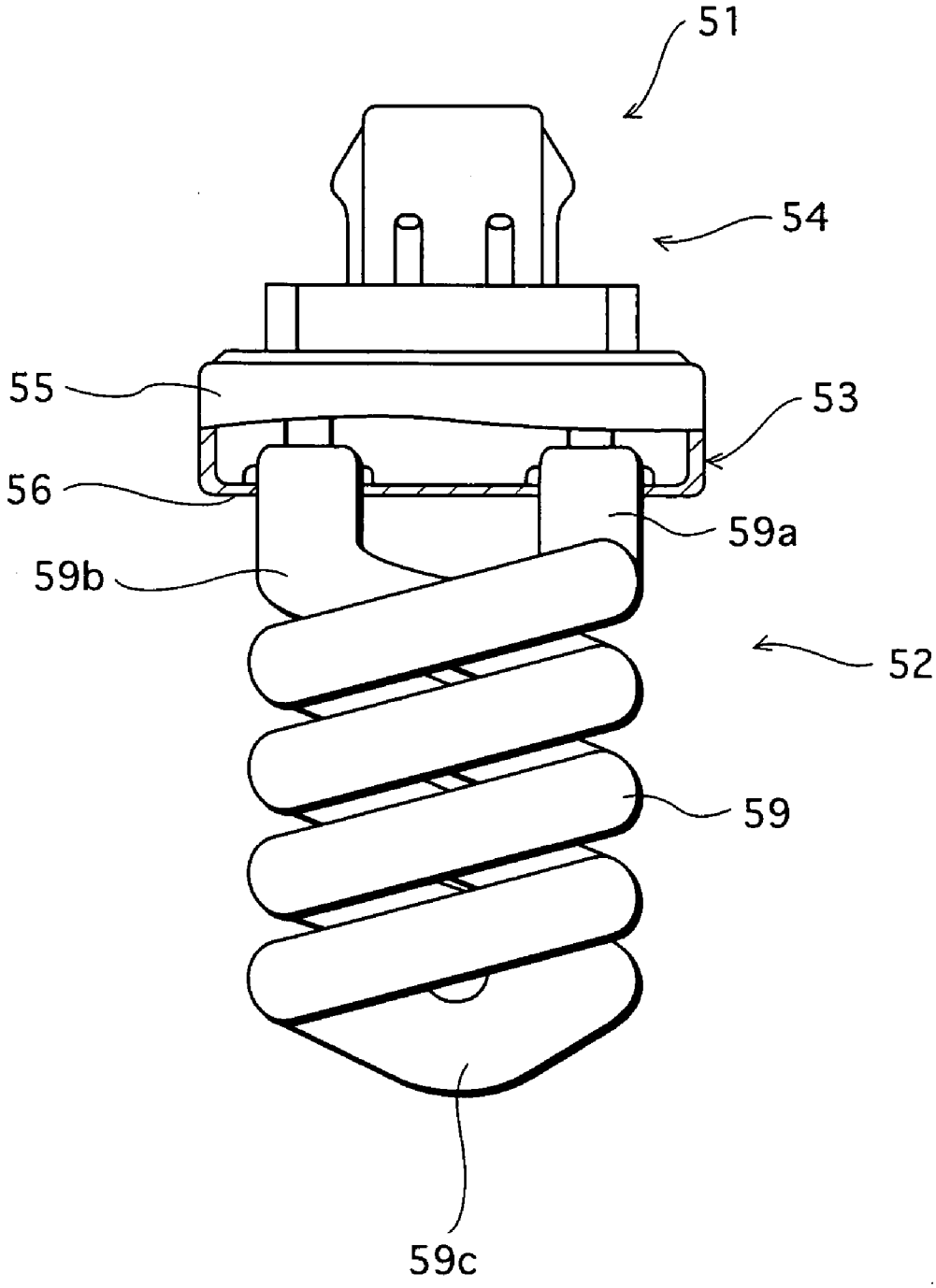
FIG. 7 is a front view illustrating the overall structure of a fluorescent lamp, which is shown as an example of low-pressure mercury lamps, with parts cut away to reveal the internal arrangements.

FIG. 7 is a front view illustrating the overall structure of a fluorescent lamp, which is shown as an example of low-pressure mercury lamps, with parts cut away to reveal the internal arrangements.

As shown in FIG. 7, the fluorescent lamp 51 is composed of: a double-spiral arc tube 52 in which a glass tube 59 is bent double at the turning part 59*c* and both limbs of the bent glass tube spiral around the pivotal axis (not shown); a holding member 53 holding the arc tube 52; and a single-ended base 54 provided on the opposite side of the holding member 53 from the arc tube 52.

The arc tube 52 has the same structure as the arc tube described in the above first embodiment.

The holding member 53 comprises: a holder 56 retaining the ends 59*a* and 59*b* of the glass tube 59; and the case 55 attached to the marginal rim of the holder 56. Here, the base type GX24q is used for the single-ended base 54, however other base types, for example GX10, can be used.

INDUSTRIAL APPLICABILITY

The arc tube of the present invention can be applied to a compact low-pressure mercury lamp with excellent performance. In addition, the low-pressure mercury lamp of the present invention can be used as a compact light source with excellent lamp performance.

The invention claimed is:

1. An arc tube having a glass tube that is wound into a spiral, wherein the glass tube has an inner shape of a substantially circular cross section, with an inner tube diameter in a range of 5 mm to 9 mm inclusive, and a bulb wall loading is set so that a temperature of a coldest spot within the glass tube under steady state illumination falls into a range of 60° C. to 65° C. inclusive.

2. The arc tube of claim 1, wherein the bulb wall loading is set within a range of 0.08 W/cm$^2$ to 0.12 W/cm$^2$ inclusive.

3. The arc tube of claim 2, wherein the glass tube is in a shape of a double-spiral comprising a turning part, a first spiral part, and a second spiral part, the turning part being located in substantially a midsection of the glass tube, the first spiral part starting from one end of the glass tube and spiraling around a pivotal axis to reach the turning part, the second spiral part starting from the turning part and spiraling around the pivotal axis to the other end of the glass tube.

4. The arc tube as recited in one of claim 3, wherein the glass tube is formed so as to fit into a cylindrical space of maximum diameter in a range of 30 mm to 40 mm inclusive and maximum length in a range of 50 mm to 100 mm inclusive.

5. A low-pressure mercury lamp that includes the arc tube as recited in claim 4.

6. The arc tube as recited in claim 3, wherein elemental mercury is sealed within the glass tube.

7. A low-pressure mercury lamp that includes the arc tube as recited in claim 3.

8. The arc tube as recited in claim 2, wherein elemental mercury is sealed within the glass tube.

9. A low-pressure mercury lamp that includes the arc tube as recited in claim 2.

10. The arc tube of claim 1, wherein the glass tube is in a shape of double-spiral comprising a turning part, a first spiral part, and a second spiral part, the turning part being located in substantially a mid-section of the glass tube, the first spiral part starting from one end of the glass tube and spiraling around a pivotal axis to reach the turning part, the second spiral part starting from the turning part and spiraling around the pivotal axis to the other end of the glass tube.

11. The arc tube as recited in claim 10, wherein elemental mercury is sealed within the glass tube.

12. A low-pressure mercury lamp that includes the arc tube as recited in claim 10.

13. The arc tube as recited in claim 1, wherein elemental mercury is sealed within the glass tube.

14. A low-pressure mercury lamp that includes the arc tube as recited in claim 1.

15. An arc tube having a glass tube that is wound into a spiral, wherein the glass tube has an inner shape of a substantially elliptical cross section, with an inner tube major axis in a range of 5 mm to 9 mm inclusive and an inner tube minor axis of 3 mm or larger, a bulb wall loading is set so that a temperature of a coldest spot within the glass tube under steady state illumination falls into a range of 60° C. to 65° C. inclusive.

16. The arc tube as recited in claim 15, wherein elemental mercury is sealed within the glass tube.

17. A low-pressure mercury lamp that includes the arc tube as recited in claim 15.

18. In a low-pressure mercury lamp, the improvement of a glass tube comprising:

the glass tube configured to have a shape of double-spiral comprising a turning part, a first spiral part, and a second spiral part, the turning part being located in substantially a midsection of the glass tube, the first spiral part starting from one end of the glass tube and spiraling around a pivotal axis to reach the turning part, the second spiral part starting from the turning part and spiraling around the pivotal axis to the other end of the glass tube; and a bulb wall loading is set within a range of 0.08 $W/cm^2$ *to* 0.12 $W/cm^2$ inclusive, so that a temperature of a coldest spot within the glass tube under steady state illumination falls into a range of 60° C. to 65° C. inclusive.

* * * * *